US009009889B1

(12) United States Patent
Cohen

(10) Patent No.: US 9,009,889 B1
(45) Date of Patent: Apr. 21, 2015

(54) PILLOWCASE WITH A POCKET

(71) Applicant: Diane Cohen, Bedford, MA (US)

(72) Inventor: Diane Cohen, Bedford, MA (US)

( * ) Notice: Subject to any disclaimer, the term of this patent is extended or adjusted under 35 U.S.C. 154(b) by 0 days.

(21) Appl. No.: 14/168,560

(22) Filed: Jan. 30, 2014

Related U.S. Application Data

(63) Continuation-in-part of application No. 29/479,150, filed on Jan. 13, 2014.

(51) Int. Cl.
*A47G 9/02* (2006.01)

(52) U.S. Cl.
CPC ..... *A47G 9/0253* (2013.01)

(58) Field of Classification Search
USPC ..... 5/490, 485, 482
See application file for complete search history.

(56) References Cited

U.S. PATENT DOCUMENTS

| | | | | |
|---|---|---|---|---|
| 1,382,831 | A | 6/1921 | Hilker | |
| 1,617,822 | A | 3/1926 | O'Leary | |
| 2,545,970 | A | 3/1951 | Rand | |
| 2,637,861 | A | 5/1953 | Kethledge | |
| 2,962,731 | A | 12/1960 | Bounds | |
| 3,863,283 | A | 2/1975 | Mohr | |
| 4,185,673 | A | 1/1980 | Daniello | |
| 4,222,468 | A | 9/1980 | De Fries | |
| 4,688,286 | A | 8/1987 | Miker, Jr. | |
| D309,392 | S | 7/1990 | Hafvenstein et al. | |
| D320,522 | S | 10/1991 | Deremiah | |
| 5,084,928 | A * | 2/1992 | Skillington | 5/490 |
| 5,138,728 | A | 8/1992 | Aston | |
| 5,168,590 | A | 12/1992 | O'Sullivan | |
| D346,086 | S | 4/1994 | Jones | |
| 5,729,846 | A | 3/1998 | Sullivan | |
| D397,902 | S | 9/1998 | Knorrek | |
| 6,065,164 | A * | 5/2000 | Swanger et al. | 5/420 |
| D431,745 | S | 10/2000 | Jackson | |
| 6,216,297 | B1 | 4/2001 | Lemke | |
| 6,267,638 | B1 | 7/2001 | Connolly et al. | |
| D448,960 | S | 10/2001 | Leverette | |
| D461,988 | S | 8/2002 | Sandbeck | |
| 6,643,870 | B2 * | 11/2003 | Bertrand | 5/482 |

(Continued)

FOREIGN PATENT DOCUMENTS

| | | |
|---|---|---|
| CA | 2543337 | 4/2013 |
| CN | 201260557 | 6/2009 |

(Continued)

OTHER PUBLICATIONS

NOA issued on Dec. 23, 2014 in U.S. Appl. No. 29/479,150.

(Continued)

*Primary Examiner* — Robert G Santos
*Assistant Examiner* — Ifeolu Adeboyejo
(74) *Attorney, Agent, or Firm* — Onello & Mello LLP

(57) ABSTRACT

A pillowcase with storage includes a pillow portion and a storage portion extending from an opening of the pillow portion. The pillow portion includes a top panel and a bottom panel coupled together to form a pillow pocket, having an opening to receive a pillow. The storage portion defines at least one storage compartment and internally attaches to the pillow portion, within its opening. The storage portion can optionally include a closure to retain its contents. The storage portion can be configured to hold electronic devices, books, medications, reading glasses, phones, and so forth, in a manner that does not interfere with the use of a pillow inside the pillow portion.

17 Claims, 7 Drawing Sheets

(56) References Cited

U.S. PATENT DOCUMENTS

| | | | | |
|---|---|---|---|---|
| D482,923 | S | 12/2003 | Gaines | |
| 6,668,400 | B1 | 12/2003 | Nichols et al. | |
| D485,723 | S | 1/2004 | Salazar | |
| 6,802,092 | B1 * | 10/2004 | Klein | 5/420 |
| 6,910,237 | B2 * | 6/2005 | DiGirolamo | 5/636 |
| 7,043,786 | B1 | 5/2006 | Hall et al. | |
| 7,089,617 | B1 | 8/2006 | Lauro | |
| 7,322,057 | B2 | 1/2008 | Merlini | |
| D613,543 | S | 4/2010 | Tinker, Sr. | |
| D651,841 | S | 1/2012 | Nayman | |
| D699,052 | S | 2/2014 | Jalan | |
| D702,971 | S | 4/2014 | Mitchell | |
| 2004/0107500 | A1 * | 6/2004 | Pigg | 5/413 R |
| 2009/0255059 | A1 * | 10/2009 | Ascroft et al. | 5/413 R |
| 2013/0025060 | A1 | 1/2013 | Shull et al. | |
| 2014/0000037 | A1 | 1/2014 | Donohue | |

FOREIGN PATENT DOCUMENTS

| | | |
|---|---|---|
| CN | 201337222 | 11/2009 |
| CN | 201718896 | 1/2011 |

OTHER PUBLICATIONS

Pillow Pocket Pal [online]. Diane O'Dette Cohen's Facebook Profile Jan. 28, 2014, FaceBook [retrieved on Dec. 12, 2014]. Retrieved from the Internet>https://plus.google.com/...photos/photo/5974052883552466898?pid=5974052883552466898&oid=103646632100862998140>.

Pillow Pod [online]. dorm co.com [retrieved on Dec. 12, 2014]. Retrieved from the Internet:,http://www.dormco.com/Pillow_Pod?Pillowcase?with?Hidden?Compartment?p/gh1-3-2-nex-niss-a.htm>.

* cited by examiner

PILLOWCASE WITH A POCKET

CROSS-REFERENCE TO RELATED APPLICATIONS

This U.S. non-provisional application is a continuation-in-part application of U.S. patent application Ser. No. 29/479,150 filed on Jan. 13, 2014, the contents of which are herein incorporated by reference in their entirety.

FIELD OF INVENTION

The present invention relates to pillowcases, and more particularly to a pillowcase having a pocket for storing objects.

BACKGROUND

Pillowcases, i.e., a fabric structure used to enclose a pillow, have been widely used and known for many years. A typical pillowcase, particularly for a bed pillow, is formed of two pieces of fabric sewn together on three sides to form an internal pocket configured to receive the bed pillow. Beyond internally receiving the bed pillow, a pillowcase is generally not made to hold any other object.

However, while extremely uncommon, there is a pillowcase that has been formed in the usual manner but with the addition of an external pocket designed to hold a small object. The external pocket can include a closure, such as a zipper. The pocket is formed externally on either the top or bottom piece of fabric forming the pillow, depending on how the pillow is flipped. Such pocket is also sewn to the external portion of the pillow in at least three sides. To date, such pillowcases with external pockets do not appear to have gained any measure of popularity, perhaps because the external pocket could be uncomfortable to the user.

SUMMARY OF INVENTION

The pillowcase in accordance with aspects of the present inventive concepts provides an externally accessible storage pocket that is attached at an internal portion of the pillowcase, where such pocket does not obstruct one's use of the pillow therein.

In accordance with one aspect of the inventive concepts, provided is a pillowcase with storage including a pillow portion including a first panel and a second panel joined together to form a pillow pocket that includes a pillow portion opening to receive a pillow, and a storage portion coupled to an inside portion of the pillow portion opening and extending external to the pillow portion. The storage portion defines at least one storage compartment that is accessible from the pillow portion opening.

In some embodiments, a width of the storage portion is less than a width of the pillow portion opening.

In some embodiments, the storage portion includes a material that is different from a material comprising the pillow portion.

In some embodiments, the storage portion includes a material having a texture that is different from a texture of a material comprising the pillow portion.

In some embodiments, the storage portion includes a storage compartment opening internal to the pillow portion that is accessible externally via the pillow portion opening.

In some embodiments, the storage portion includes a third panel and a fourth panel joined together to form the at least one storage compartment and at least one storage compartment opening.

In some embodiments, a first end of the fourth panel is coupled to the first panel within the pillow portion opening.

In some embodiments, a first end of the fourth panel is coupled to the first panel within the pillow portion opening.

In some embodiments, a first end of the third panel is shorter than the first end of the fourth panel and the at least one storage compartment opening is formed between the first end of the third panel and the first end of the fourth panel.

In some embodiments, the first panel comprises a first closure and the first end of the third panel comprises a corresponding second closure that mates with the first closure at the at least one storage compartment opening.

In some embodiments, the at least one storage compartment includes at least one storage compartment opening that is accessible from the between the first panel and the storage portion.

In some embodiments, the third and fourth panels comprise fabric.

In some embodiments, the first and second panels comprise fabric.

In accordance with another aspect of the inventive concepts, a pillowcase with storage is provided. The pillowcase with storage includes a pillow portion comprising a first panel and a second panel joined together to form a pillow pocket that includes a pillow portion opening to receive a pillow, and a storage portion coupled to an inside portion of the pillow portion opening and extending external to the pillow portion, the storage portion defining at least one storage compartment that is accessible from the pillow portion opening. The storage portion comprises a third panel and a fourth panel joined together to form the at least one storage compartment and at least one storage compartment opening. A width of the storage portion is less than a width of the pillow portion opening. A first end of the fourth panel is coupled to the first panel within the pillow portion opening. A first end of the third panel is shorter than the first end of the fourth panel and the at least one storage compartment opening is formed between the first end of the third panel and the first end of the fourth panel In some embodiments, the first panel comprises a first closure and the first end of the third panel comprises a corresponding second closure that mates with the first closure at the at least one storage compartment opening.

In some embodiments, the at least one storage compartment includes at least one storage compartment opening that is accessible from the between the first panel and the storage portion.

In some embodiments, the at least one storage compartment includes at least one storage compartment opening that is accessible from the between the first panel and the storage portion.

In accordance with another aspect of the inventive concepts, a pillowcase with storage is provided. The pillowcase with storage includes a first side panel, and a second side panel coupled to the first side panel such that first and second sides of the first and second side panels and a first end of the first and second side panels are closed and a second end of the first and second side panels opposite the first end of the first and second side panels is open. The pillowcase with storage further includes a storage portion coupled to the first side panel extending from the second end of the first and second side panels in a direction opposite to the first end of the first and second side panels. A width of the storage portion is less than a width of the first and second panels. The storage portion includes a third side panel and a fourth side panel coupled to the third side panel such that first and second sides of the third and fourth side panels and a first end of the third and fourth side panels are closed and a second end of the third and fourth side panels opposite to the first end of the third and fourth side panels is open. The first, second, third and fourth side panels comprise fabric In some embodiments, the second end of the third and fourth side panels is at the second end of the first and second panels.

In some embodiments, the fourth side panel is coupled to the first side panel.

In some embodiments, the third side panel is between the fourth side panel and the first side panel.

In some embodiments, the first side panel comprises a first closure and the third side panel comprises a second closure that mates with the first closure.

DESCRIPTION OF DRAWINGS

The present invention will become more apparent in view of the attached drawings and accompanying detailed description. The embodiments depicted therein are provided by way of example, not by way of limitation, wherein like reference numerals refer to the same or similar elements. The drawings are not necessarily to scale, emphasis instead being placed upon illustrating aspects of the invention. In the drawings.

DETAILED DESCRIPTION OF PREFERRED EMBODIMENTS

Figure 1:
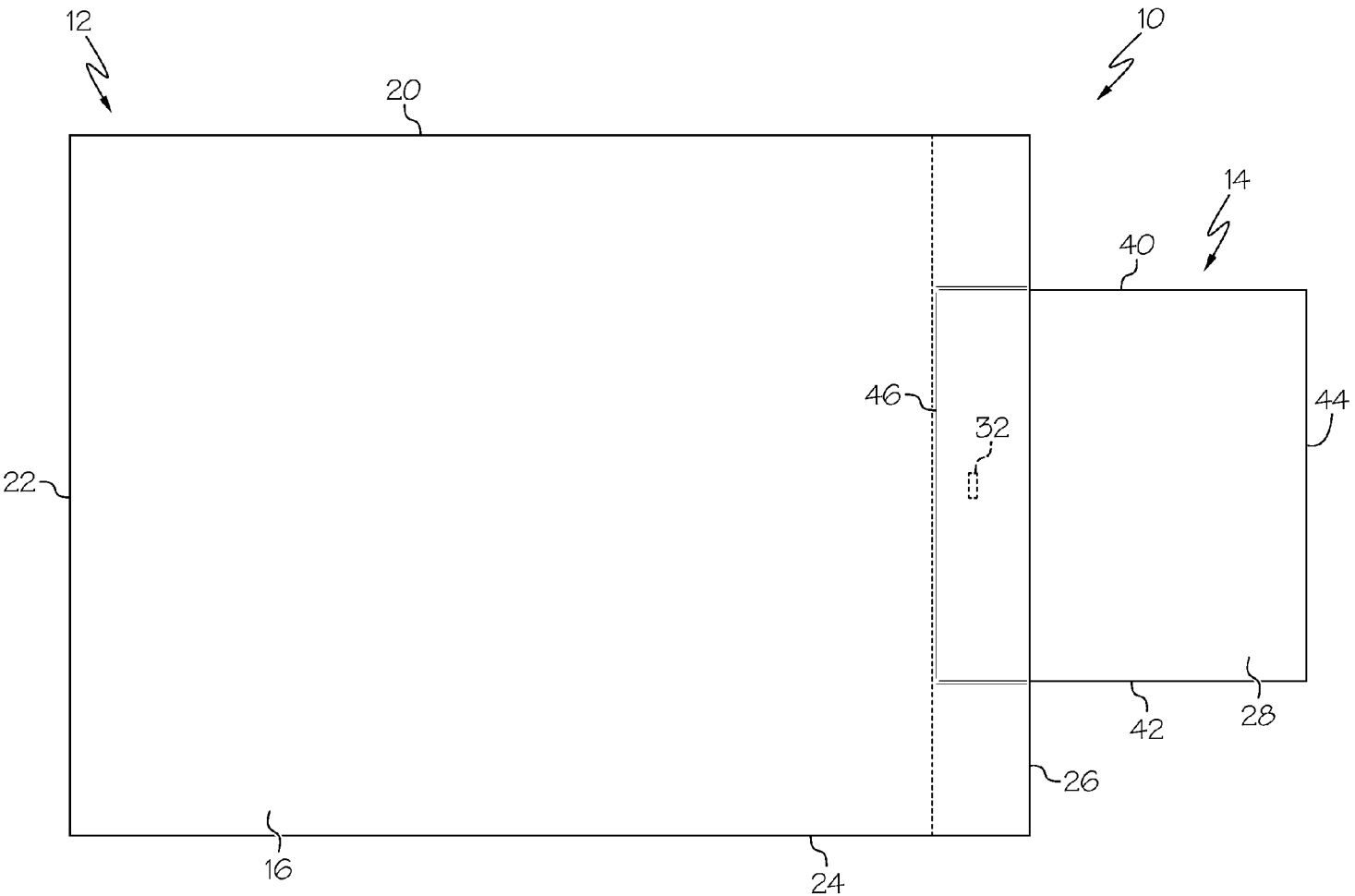
FIG. 1 is a top view of an embodiment of a pillowcase with storage, in accordance with the present inventive concepts.

Various exemplary embodiments will be described more fully hereinafter with reference to the accompanying drawings, in which some exemplary embodiments are shown. The present inventive concept may, however, be embodied in many different forms and should not be construed as limited to the exemplary embodiments set forth herein.

It will be understood that, although the terms first, second, etc. are be used herein to describe various elements, these elements should not be limited by these terms. These terms are used to distinguish one element from another, but not to imply a required sequence of elements. For example, a first element can be termed a second element, and, similarly, a second element can be termed a first element, without departing from the scope of the present invention. As used herein, the term "and/or" includes any and all combinations of one or more of the associated listed items.

It will be understood that when an element is referred to as being "on" or "connected" or "coupled" to another element, it can be directly on or connected or coupled to the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, steps, operations, elements, and/or components, but do not preclude the presence or addition of one or more other features, steps, operations, elements, components, and/or groups thereof.

Spatially relative terms, such as "beneath," "below," "lower," "above," "upper" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as "below" and/or "beneath" other elements or features would then be oriented "above" the other elements or features. The device may be otherwise oriented (e.g., rotated 90 degrees or at other orientations) and the spatially relative descriptors used herein interpreted accordingly.

A pillowcase with storage in accordance with aspects of the present invention provides at least one externally accessible storage compartment that is attached at an internal portion of the pillowcase, where such storage compartment does not obstruct one's use of the pillow therein.

Figure 2:
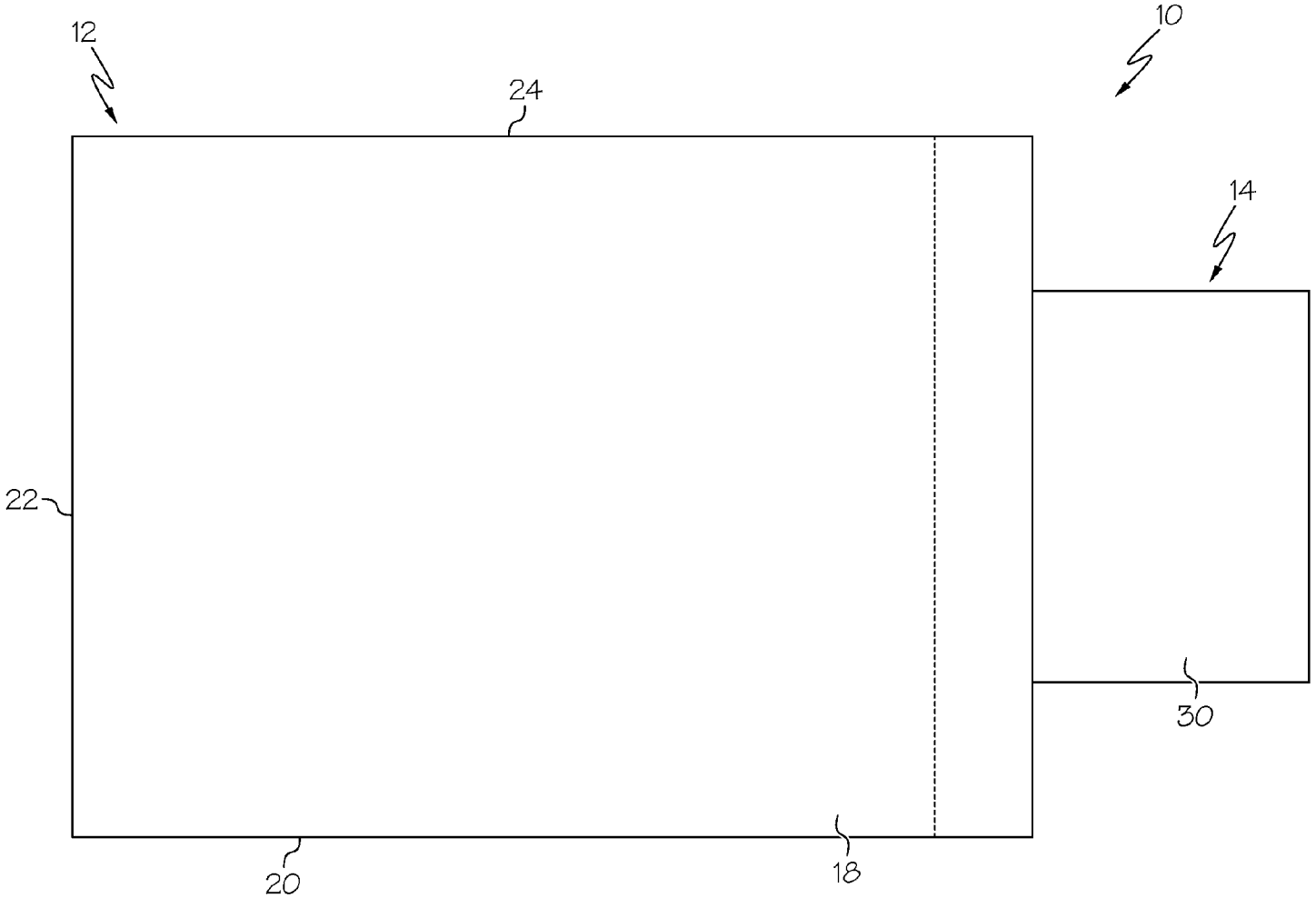
FIG. 2 is a bottom view of the pillowcase with storage of FIG. 1.
Figure 3:
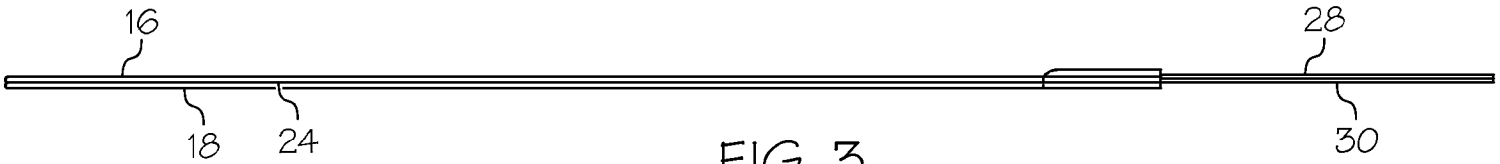
FIG. 3 is a side view of the pillowcase with storage of FIG. 1.
Figure 4:
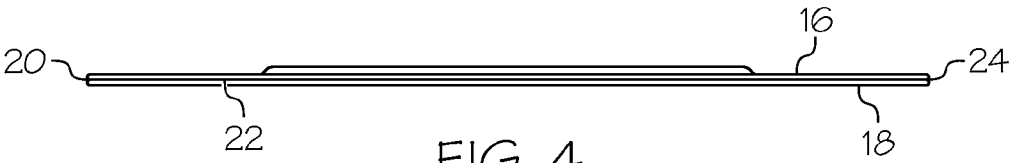
FIG. 4 is a closed end view of the pillowcase with storage of FIG. 1.
Figure 5:
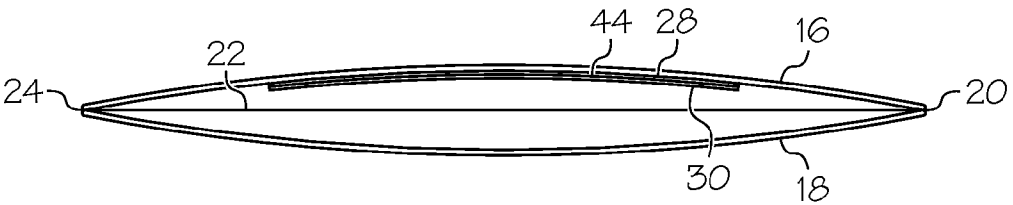
FIG. 5 is an open end view of the pillowcase with storage of FIG. 1.

FIG. 1 is a top view of an embodiment of a pillowcase with storage 10, in accordance with aspects of the present inventive concepts. FIG. 2 is a bottom view of the pillowcase with storage 10 of FIG. 1. FIG. 3 is a side view of the pillowcase with storage 10 of FIG. 1. FIG. 4 is a closed end of the pillowcase with storage 10 of FIG. 1. FIG. 5 is an open end of the pillowcase with storage 10 of FIG. 1.

Referring to FIGS. 1-5, the pillowcase with storage 10 has a pillow portion 12 to store a pillow and a storage portion 14, for example, a pocket configured to store objects. The pillow portion 12 can be formed of two flexible fabric sheets or panels 16 and 18, e.g., first panel 16 and fourth panel 18, as illustrated in FIG. 3. As used herein, a "panel" does not require a separate piece of fabric, but rather could mean a portion of a larger sheet of fabric, therefore, as an example, a folded single sheet of fabric can comprise two or more panels. In this case, therefore, panels 16 and 18 could be two sections of a single piece of cloth folded to define an end margin at the fold.

Figure 6:
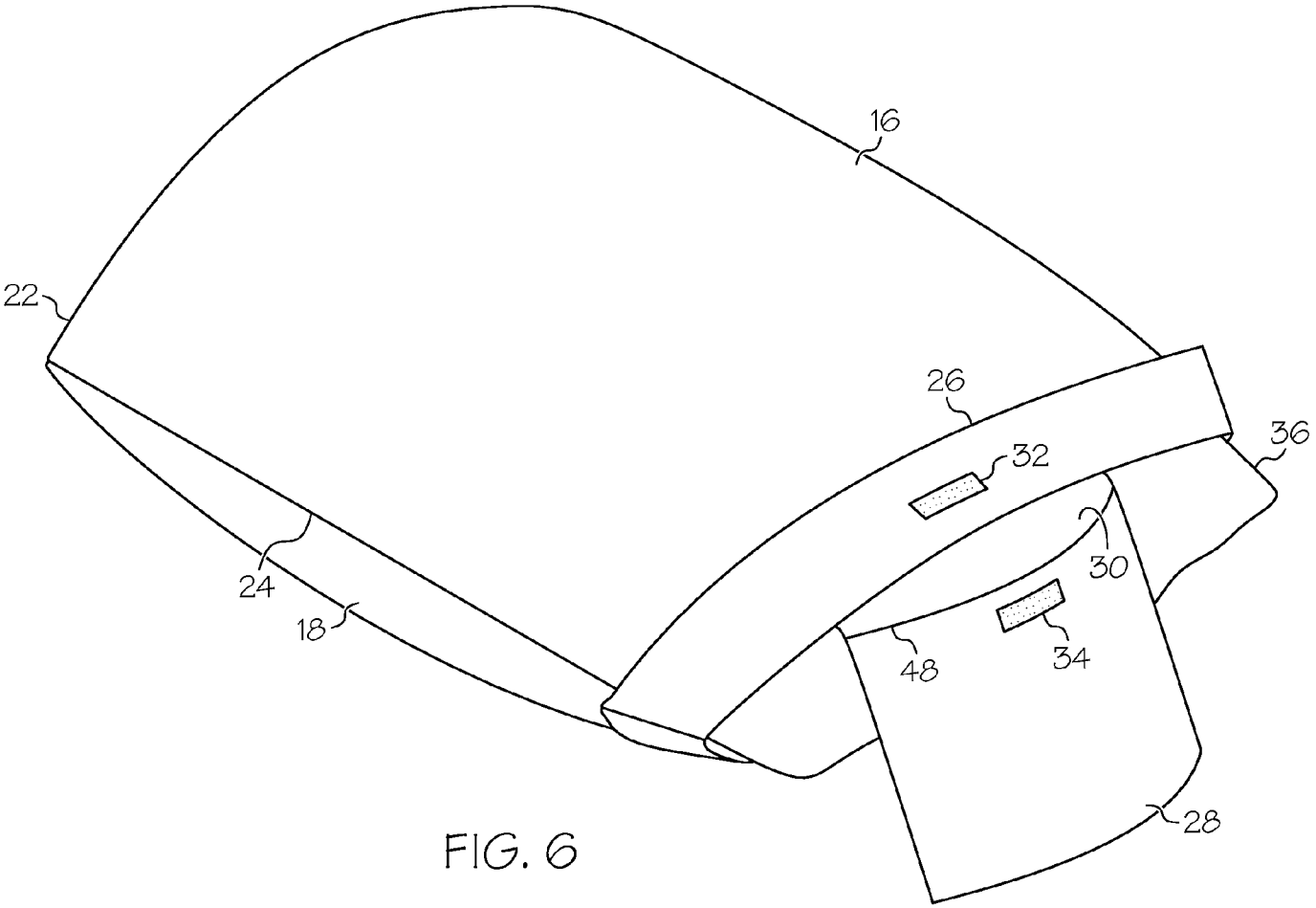
FIG. 6 is a first top perspective view of the pillowcase with storage of FIG. 1 with an end portion of pillowcase folded back.
Figure 7:
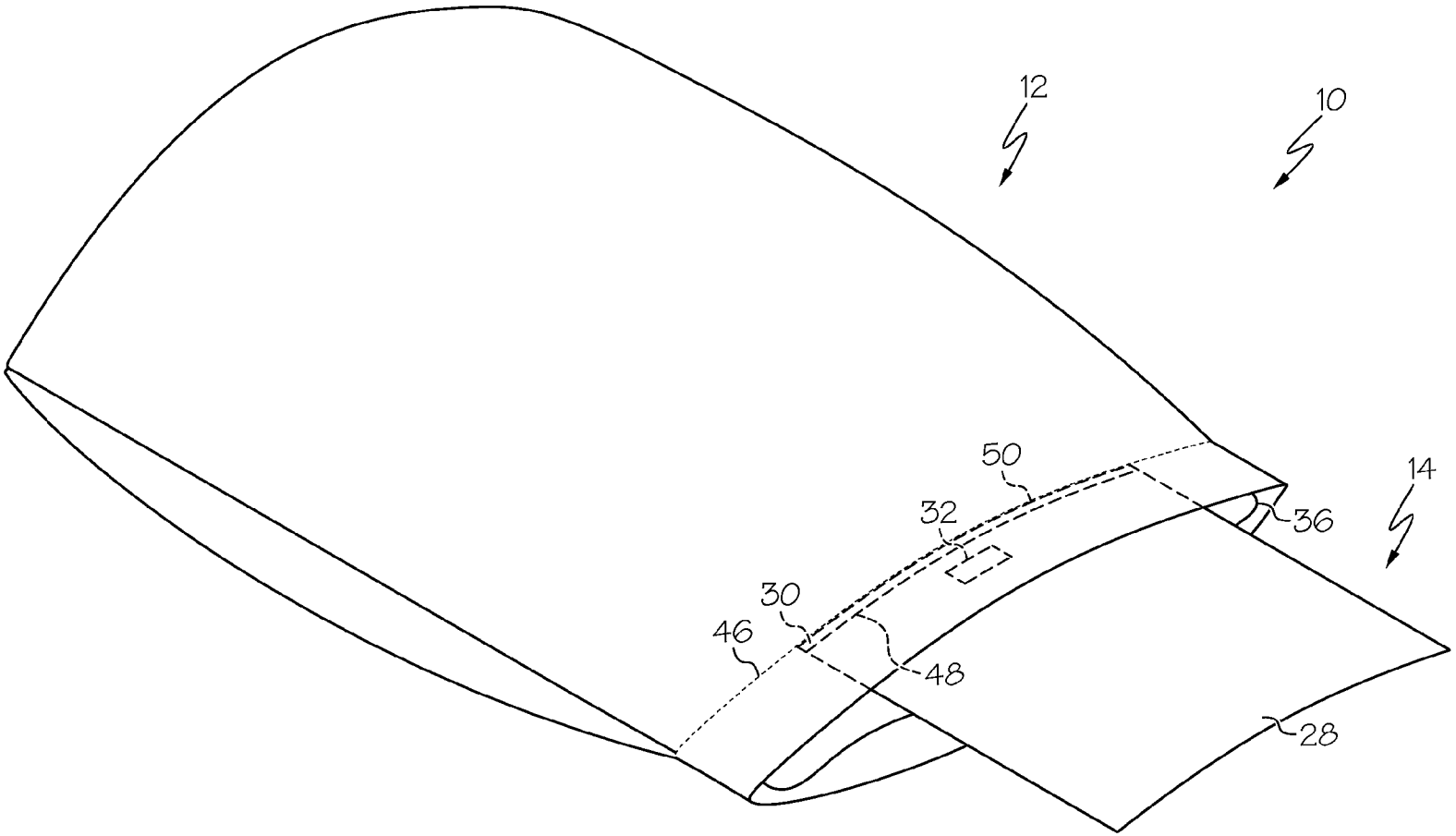
FIG. 7 is a second top perspective view of the pillowcase with storage of FIG. 1.
Figure 9:
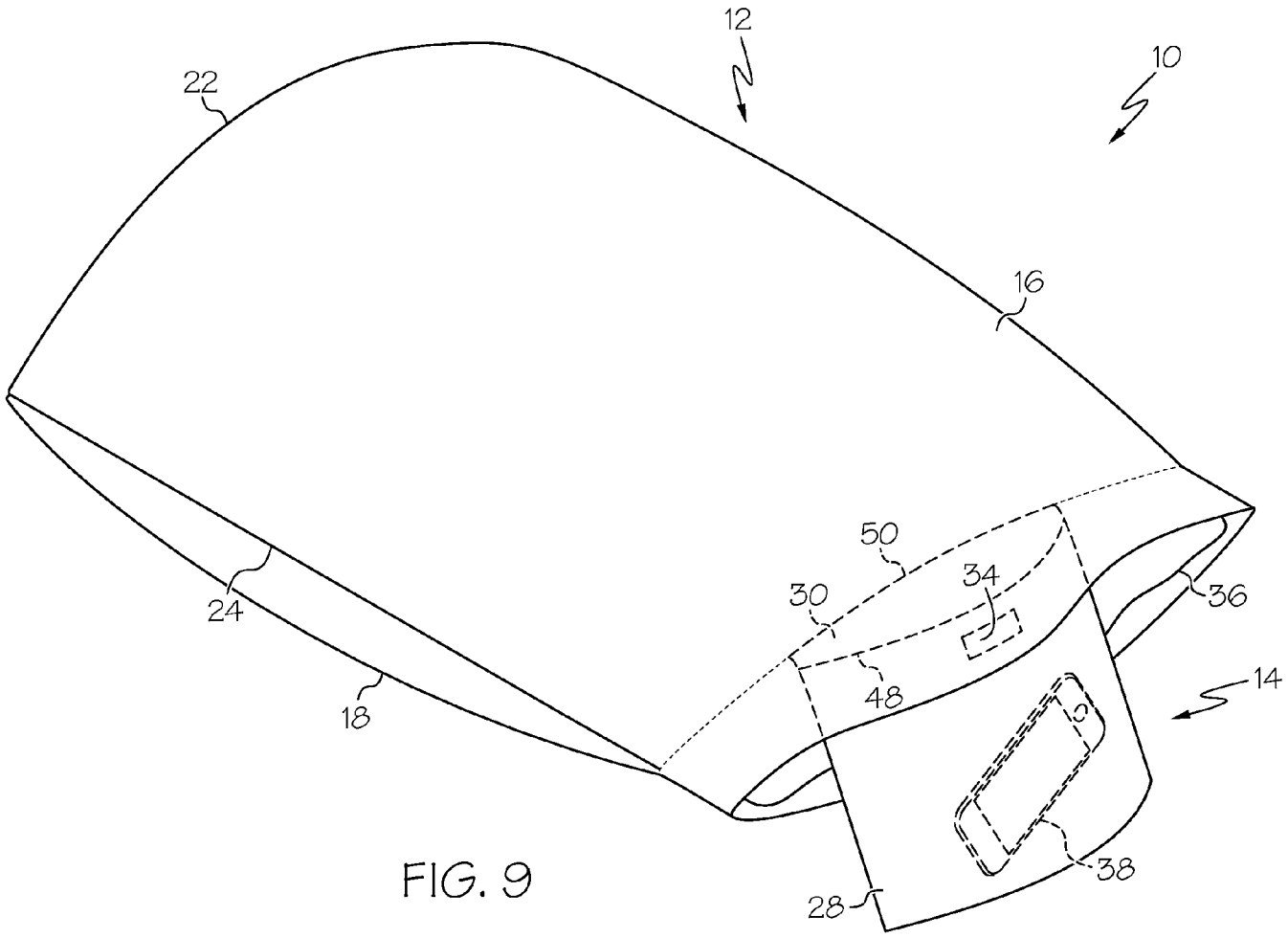
FIG. 9 is a third top perspective view of the pillowcase with storage of FIG. 1.

The fabric panels 16 and 18 may be, for example, cloth or other flexible sheet material; however, the present invention is not limited thereto. The fabric panels 16 and 18 are coupled, for example, sewn, together along entire common side margins 20 and 24 and common end margin 22. In this embodiment, the fabric panels 16 and 18 of the pillow portion 12 are closed along the side margins 20 and 24 and end margin 22 of the pillow portion 12, for example, one or more of such margins 20, 22, 24 could be closed by a fold in the material and/or by stitching or sewing. The fabric panels 16 and 18 are left open along one end margin to define an open end 26 of the pillow portion 12. Accordingly, the fabric panels are configured to form a pillow pocket, where the open end 26 of the pillow portion 12 is configured to receive a pillow 36 into the pillow pocket. As illustrated in FIGS. 6, 7, and 9, the pillow 36 may be inserted between fabric panels 16 and 18 into the pillow pocket via the open end 26. The side 22 is a closed end opposite the open end 26.

Figure 8:
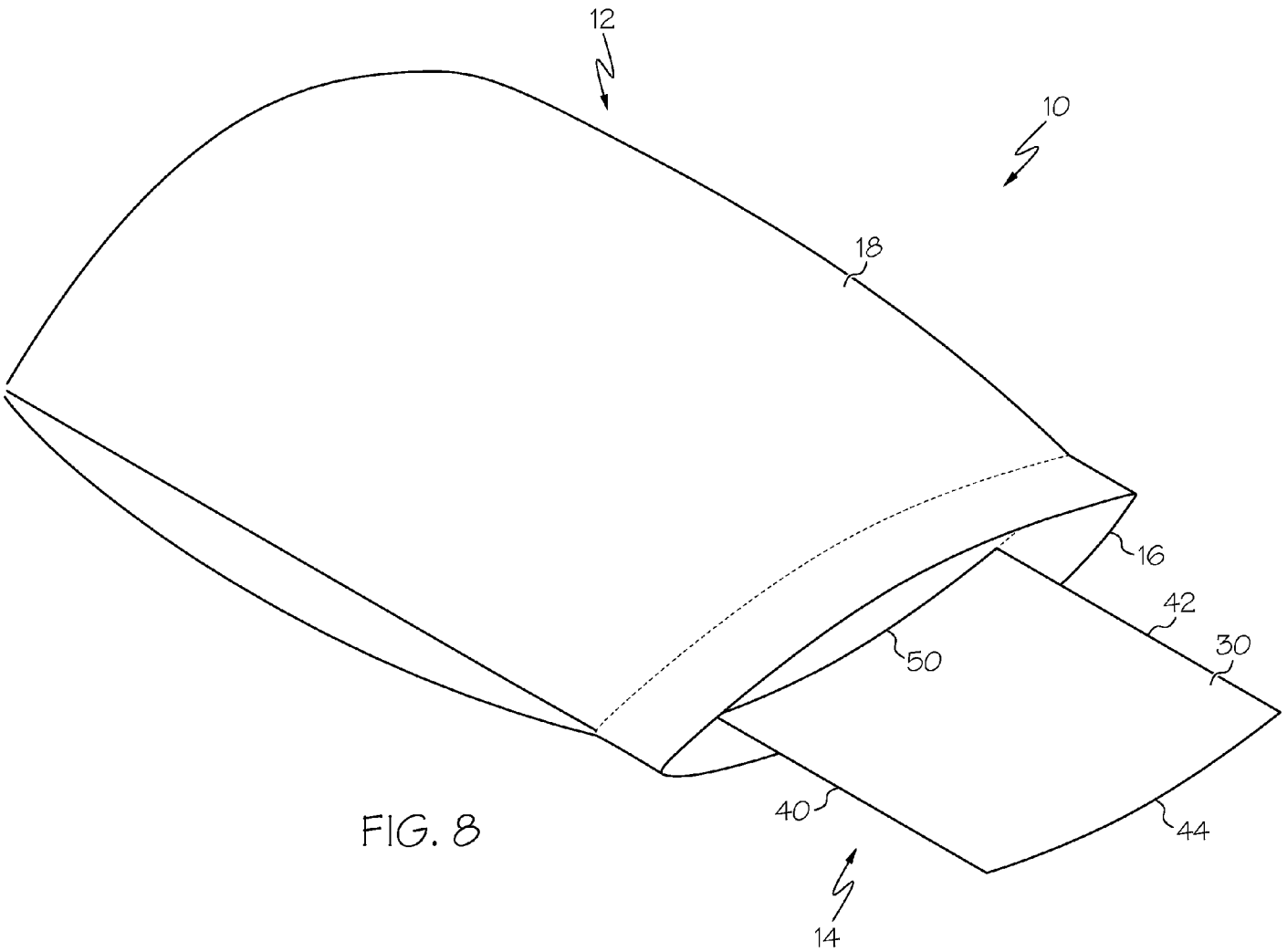
FIG. 8 is a bottom perspective view of the pillowcase with storage of FIG. 1.

FIG. 6 is a first top perspective view of the pillowcase with storage 10 of FIG. 1 with an end portion of pillow portion 12 folded back. FIG. 7 is a second top perspective view of the pillowcase with storage 10 of FIG. 1. FIG. 8 is a bottom perspective view of the pillowcase with storage 10 of FIG. 1.

In this embodiment, the storage portion 14 extends from the open end 26 of the pillow portion 12 in a direction opposite to the closed end 22 of the pillow portion 12. Also in this embodiment, the storage portion 14 extends from an interior of the pillow portion 12 to an exterior of the pillow portion 12 and hangs to the side of the pillow portion 12 such that the storage portion 14 does not interfere with the use of the pillow portion 12. In particular, in this embodiment, storage portion 14 is attached to an internal portion of panel 16. Storage portion 14 can be permanently attached to the panel 16, e.g., sewn to the panel 16, or it can be removably attached to the panel 16, e.g., by Velcro, a zipper, snaps, buttons, an adhesive, or some other form of removable mechanism.

The storage portion 14 is of a width that is smaller than the width of the pillow portion 12 in this embodiment. However, the size of the storage portion 14 is not limited thereto; the width of the storage portion 14 may be wider or narrower than illustrated in various embodiments. Additionally, the storage portion 14 is shown as a rectangle in the figures, but it can be other shapes in other embodiments, e.g., square, circular, oval, conical, truncated cone, trapezoidal, and so forth. In some embodiments, the storage portion can take the form of a durable bag, as an alternate. There is no inherent limit in the shape of the storage portion 14. The storage portion 14 can define a single storage compartment or be divided into multiple storage compartments.

FIG. 9 is a third top perspective view of the pillowcase with storage of FIG. 1. As illustrated in the embodiment of FIG. 9, when the pillow 36 is inserted into the pillow portion 12, the storage portion 14 hangs over the pillow 36—when panel 16 is on top. That is, when the pillow 36 is inserted into the pillow portion 12, the storage portion 14 is between the pillow 36 and the fabric panel 16 of the pillow portion 12 and hangs to the side of the pillow 36 and pillow portion 12. The storage portion 14 is illustrated having a mobile device 38 therein; however, the present invention is not limited thereto. The storage portion 14 may hold, for example, a book, an Apple iPad or other tablet, electronic book reader (e.g., Amazon's Kindle), a phone, a wallet, jewelry, food, medications, or the like.

In this embodiment, the storage portion 14 is formed of two flexible fabric sheets or panels, e.g., third panel 28 and fourth panel 30, as illustrated in FIG. 3. The fabric panels 28 and 30 may be, for example, cloth or the like; however, the present invention is not limited thereto. In other embodiments, the storage portion 14 could be made by a single piece of material or more than two pieces (or panels) of material.

In various embodiments, the storage portion 14 can be made of the same type of fabric as the pillow portion, e.g., cotton, silk, and so on. But in other embodiments, the storage portion 14 could be made of or partially include a type of fabric or texture that is different, e.g., a mesh, from that of the pillow portion 12. A difference in material and/or texture between the pillow portion 12 and the storage portion 14 could assist a user in locating the storage portion (and its contents) in the dark, e.g., in the middle of the night.

As illustrated in FIGS. 1-3 and 5, the fabric panels 28 and 30 are closed along common side margins 40 and 42 and common end margin 44, for example, one or more of such margins 40, 42, 44 could be closed by a fold in the material and/or by stitching or sewing. The fabric panels 28 and 30 are left open along one end margin to define an open end 46 of the storage portion 14. The side 44 is a closed end opposite the open end 46. The open end 46 of the storage portion 14 is positioned at an interior of the pillow portion 12 at the open end 26 of the pillow portion 12.

As illustrated in FIGS. 5 and 6, the storage portion 14 is coupled to the fabric sheet 16 of the pillow portion 12. Referring to FIG. 8, an end 50 of the fabric panel 30 is coupled, for example, stitched or sewn, to an interior portion of the fabric sheet 16 of the pillow portion 12. The fabric panel 28 of the storage portion 14 is between the fabric sheet 30 of the storage portion 14 and the fabric sheet 16 of the pillow portion 12. Referring to the embodiment of FIGS. 6, 7 and 8, the fabric panel 28 is shorter in length than the fabric sheet 30. That is, the end 50 of the panel sheet 30 is spaced apart from the end 48 of the fabric sheet 28.

An object may be inserted into the storage portion 14 through the open end 46 of the storage portion between fabric sheets 28 and 30, as discussed above. The open end 46 of the storage portion 14 can include a closure that maintains the object therein. Such closure could be made of or include, as examples, Velcro, a zipper, snaps, buttons, an adhesive, or some other form of closure.

As illustrated in FIGS. 6 and 9, the pillow portion 12 can optionally include a closure 32, for example, a Velcro strip or the like, on an interior of the fabric panel 16 at the open end 26 of the pillow portion 12. The fabric panel 28 of the storage portion 14 can include a corresponding closure 34, for example, a Velcro strip or the like, which mates with the closure 32 to close the open end 46 of the storage portion 14. Thus, in this embodiment, a closure of the storage portion 14 is formed with the pillow portion 12. In this embodiment, therefore, the interior of the fabric panel 16 of the pillow portion 12 can be coupled or fastened to the fabric panel 28 of the storage portion 14. The mating closures 32 and 34 are described as Velcro strips in this embodiment, however, the invention is not limited thereto. Any suitable closure device may be used. For example, the mating closures 32 and 34 can be or include at least one button and button hole for receiving the button, or a snap button. In other embodiments, the pillowcase with storage 10 may not include a closure for the storage portion 14.

In some embodiments, the storage portion 14 may be tucked into the pillow portion 12 through the open end 26 of the pillow portion 12. Thus, the storage portion 14 and/or the contents in the storage portion 14 may be hidden within the pillow portion 12, e.g., under the pillow. For example, when the storage portion 14 is not in use, the thin, low profile of the storage portion 14 enables it to be stored within the pillow portion 12 without adverse consequence to a user of the pillow—such as uncomfortable bulges or lumps.

A pillowcase with storage in accordance with aspects of the present invention provides an easily accessible storage compartment for a pillowcase without interfering with the use of the pillow and pillowcase. The storage compartment extends from an interior end portion of the pillowcase to an exterior of the pillowcase and hangs along the side of the pillowcase and/or pillow. Thus, the contents of the storage compartment are not on or under the pillowcase and a user may place its head anywhere on the pillowcase without feeling the contents of the storage compartment.

While the foregoing has described what are considered to be the best mode and/or other preferred embodiments, it is understood that various modifications can be made therein and that the invention or inventions may be implemented in various forms and embodiments, and that they may be applied in numerous applications, only some of which have been described herein. It is intended by the following claims to claim that which is literally described and all equivalents thereto, including all modifications and variations that fall within the scope of each claim.

What is claimed is:

1. A pillowcase with storage, comprising:

a pillow portion including a first panel and a second panel joined together to form a pillow pocket that includes a first end opening configured to receive a pillow into the pillow pocket; and a storage portion coupled to an inside portion of the first end opening and laterally extending from the first end opening and external to the pillow portion to not obstruct use of the pillow in the pillow pocket, the storage portion defining at least one storage compartment that is accessible from the first end opening, wherein the storage portion includes a storage compartment opening internal to the pillow portion that is accessible externally via the first end opening and wherein end portions of a top and a bottom of the storage compartment opening are internal to the pillow portion, and wherein the storage portion comprises:

a third panel and a fourth panel joined together to form the at least one storage compartment and at least one storage compartment opening, wherein a first end of the fourth panel is coupled to the first panel within the first end opening, and wherein the at least one storage compartment opening is between the fourth panel and the first panel.

2. The pillowcase of claim 1, wherein a width of the storage portion is less than a width of the first end opening.

3. The pillowcase of claim 1, wherein storage portion includes a material that is different from a material comprising the pillow portion.

4. The pillowcase of claim 1, wherein storage portion includes a material having a texture that is different from a texture of a material comprising the pillow portion.

5. The pillowcase of claim 1, wherein a first end of the third panel is shorter than the first end of the fourth panel and the at least one storage compartment opening is formed between the first end of the third panel and the first end of the fourth panel.

6. The pillowcase of claim 1, wherein the first panel comprises a first closure and a first end of the third panel comprises a corresponding second closure that mates with the first closure at the at least one storage compartment opening.

7. The pillowcase of claim 1, wherein the at least one storage compartment includes at least one storage compartment opening that is accessible from between the first panel and the storage portion.

8. The pillowcase of claim 1, wherein the third and fourth panels comprise fabric.

9. The pillowcase of claim 1, wherein the first and second panels are closed at a top margin, a bottom margin, and a second end margin opposite the first end opening.

10. A pillowcase with storage, comprising:

a pillow portion comprising a first panel and a second panel joined together to form a pillow pocket that includes a first end opening configured to receive a pillow into the pillow pocket;

a storage portion coupled to an inside portion of the first end opening and laterally extending from the first end opening and external to the pillow portion to not obstruct use of the pillow in the pillow pocket, the storage portion defining at least one storage compartment that is accessible from the first end opening, the storage portion comprising a third panel and a fourth panel joined together to form the at least one storage compartment and at least one storage compartment opening, wherein:

a width of the storage portion is less than a width of the first end opening, a first end of the fourth panel is coupled to the first panel within the first end opening, a first end of the third panel is shorter than the first end of the fourth panel and the at least one storage compartment opening is formed between the first end of the third panel and the first end of the fourth panel, and the at least one storage compartment opening is internal to the pillow portion and is accessible externally via the first end opening, wherein the first end of the third panel and the first end of the fourth panel are internal to the pillow portion and wherein the at least one storage compartment opening is between the fourth panel and the first panel.

11. The pillow case of claim 10, wherein the first panel comprises a first closure and the first end of the third panel comprises a corresponding second closure that mates with the first closure at the at least one storage compartment opening.

12. The pillowcase of claim 10, wherein the at least one storage compartment includes at least one storage compartment opening that is accessible from the between the first panel and the storage portion.

13. A pillowcase with storage, comprising:

a rectangular pillow portion having top, bottom, first end, and second end margins, wherein the top and bottom margins are longer than the first and second end margins, and the top, bottom, and second end margins are closed and the first end margin is open to receive a pillow into a pillow pocket; and a storage pocket configured to store objects partially extending from the pillow portion, the storage pocket having a first end attached to an internal portion of the pillow portion and a second end extending external to the pillow portion via the open first end margin in a manner that does not interfere with the use of the pillow inside the pillow portion, the storage pocket having a storage pocket opening that is internal to the pillow portion and is accessible via the open first end margin, wherein the open first end margin and storage pocket opening are opposite to each other, and wherein an end of a bottom of the storage pocket is coupled to a top of the pillow portion and the storage pocket opening is between the bottom of the storage pocket and the top of the pillow portion.

14. The pillowcase with storage of claim 13, wherein the storage pocket is permanently attached to the internal portion of the pillow portion.

15. The pillowcase with storage of claim 13, wherein the storage pocket is removably attached to the internal portion of the pillow portion.

16. The pillowcase with storage of claim 13, wherein the storage pocket comprises a plurality of storage compartments.

17. The pillowcase with storage of claim 13, wherein the storage pocket opening includes a closure that closes the storage pocket opening to maintain an object therein.

* * * * *